US007484988B2

(12) United States Patent
Ma et al.

(10) Patent No.: US 7,484,988 B2
(45) Date of Patent: Feb. 3, 2009

(54) CONNECTOR CLAMPING SYSTEMS AND METHODS

(75) Inventors: JianFeng Ma, ShenZhen (CN); Peixian Hu, ShenZhen (CN)

(73) Assignee: BizLink Technology, Inc., Fremont, CA (US)

( * ) Notice: Subject to any disclaimer, the term of this patent is extended or adjusted under 35 U.S.C. 154(b) by 0 days.

(21) Appl. No.: 12/101,816

(22) Filed: Apr. 11, 2008

(65) Prior Publication Data

US 2008/0280505 A1 Nov. 13, 2008

(51) Int. Cl.
*H01R 13/627* (2006.01)

(52) U.S. Cl. ..... 439/350

(58) Field of Classification Search ..... 439/350, 439/352, 578, 584, 372, 253–256, 312, 322
See application file for complete search history.

(56) References Cited

U.S. PATENT DOCUMENTS

| | | | | |
|---|---|---|---|---|
| 3,452,316 | A * | 6/1969 | Mocek et al. | 439/255 |
| 4,525,016 | A | 6/1985 | Williams | |
| 4,941,846 | A * | 7/1990 | Guimond et al. | 439/578 |
| 5,013,254 | A | 5/1991 | Williams | |
| 5,021,002 | A | 6/1991 | Noschese | |
| 5,595,499 | A | 1/1997 | Zander | |
| 5,637,450 | A * | 6/1997 | Bohn | 435/2 |
| 6,093,043 | A * | 7/2000 | Gray et al. | 439/352 |
| 6,267,612 | B1 * | 7/2001 | Arcykiewicz et al. | 439/253 |
| 6,464,526 | B1 | 10/2002 | Seufert | |
| 6,517,373 | B2 | 2/2003 | Finke | |
| 6,749,454 | B2 | 6/2004 | Schmidt | |
| 6,762,940 | B2 | 7/2004 | Zaremba | |
| 6,884,105 | B2 | 4/2005 | Turck | |
| 7,052,186 | B1 | 5/2006 | Bates | |
| 7,175,464 | B2 | 2/2007 | Ferderer et al. | |
| 7,189,113 | B2 * | 3/2007 | Sattele et al. | 439/578 |
| 7,201,608 | B2 | 4/2007 | Rosenberger | |
| 7,364,450 | B2 * | 4/2008 | Hafner et al. | 439/255 |
| 2003/0096532 | A1 | 5/2003 | Krause | |
| 2007/0042630 | A1 * | 2/2007 | Huning et al. | 439/350 |
| 2007/0042640 | A1 | 2/2007 | Rosenberger | |

* cited by examiner

*Primary Examiner*—Alexander Gilman
(74) *Attorney, Agent, or Firm*—Law Office of Andrei D. Popovici, P.C.

(57) ABSTRACT

According to some embodiments, an electrical connector assembly comprises an electrical connector body and a clamping collar disposed over the electrical connector body. The electrical connector body comprises a pair of opposing latch hook strips parallel to an insertion direction of the electrical connector body. Each latch hook strip has an inward-facing latch hook situated along a distal region of an inner surface of the latch hook strip, and a forward-facing, inner-surface slanted platform. The clamping collar is slidably disposed over the latch hook strips. The clamping collar comprises a pair of backward-facing slanted platforms, each configured to engage a corresponding forward-facing slanted platform of a latch hook strip. Sliding the clamping collar forward along the latch hook strips clamps the latch hooks to secure the connector, and sliding the clamping collar backward along the latch hook strips unclamps the latch hooks to release the connector.

15 Claims, 3 Drawing Sheets

CONNECTOR CLAMPING SYSTEMS AND METHODS

RELATED APPLICATION DATA

This application is based upon and claims the benefit of priority from prior Chinese Patent Application No. 200720119971.3, filed May 8, 2007, which is herein incorporated by reference.

BACKGROUND

The present invention relates to electrical connector systems and methods, and in particular to connector clamping seat structures for use for example in solar energy junction boxes.

A number of practical applications involve interconnecting electrical connectors. Connection types include detachable connections and permanent (not detachable) connections. A common type of detachable conductor connection used in solar energy junction boxes, for example, comprises a connector plug and a connector socket (also called a male end and a female end). Some connection designs are subject to unwanted accidental release of the connection.

SUMMARY

According to one aspect, a connector assembly comprises an electrical connector body, and clamping collar slidably disposed over the electrical connector body. The electrical connector body comprises an elongated tube, and a pair of opposing latch hook strips coupled to the elongated tube and extending along an outer surface of the elongated tube. Each latch hook strip has an inward-facing latch hook situated along a distal (forward) region of an inner surface of said each latch hook strip, and a distally-facing latch supporting slanted platform situated along the inner surface of said each latch hook strip. The clamping collar is slidably disposed over the latch hook strips, and comprises a pair of proximally-facing (backward-facing) sliding slanted platforms. Each sliding slanted platform is configured to engage a corresponding distally-facing supporting slanted platform to transversely press the latch hook strips outward when the clamping collar is slid along the latch hook strips in a proximal (backward) direction.

According to another aspect, a socket clamping structure comprises a socket body, and a clamping collar disposed over the socket body. The socket body comprises a flange ring; a threaded coupling coupled to the flange ring along a proximal side of the flange ring; an elongated tube coupled to the flange ring along a distal side of the flange ring, for attaching to an external electrical connector, wherein the elongated tube comprises an inner tube cavity interconnected to an inner bore of the threaded coupling; and a pair of latch hook strips coupled to the flange ring along the distal side of the flange ring and extending along an outer surface of the elongated tube, the pair of latch hook strips comprising a corresponding pair of latch hooks situated along corresponding distal regions and inner sides of the latch hook strips, the pair of latch hook strips further comprising a corresponding pair of supporting slanted platforms situated along corresponding inner sides of the latch hook strips. The clamping collar is slidably disposed over the latch hook strips. The clamping collar comprises a pair of sliding slanted platforms along an inner wall of the clamping collar, the sliding slanted platforms being configured to press on the supporting slanted platforms as the clamping collar is slid over the latch hook strips.

According to another aspect, an electrical connector assembly comprises an electrical connector body and a clamping collar disposed over the electrical connector body. The electrical connector body comprises a pair of opposing latch hook strips parallel to an insertion direction of the electrical connector body. Each latch hook strip has an inward-facing latch hook situated along a distal region of an inner surface of the latch hook strip, and a distally-facing latch hook strip slanted platform situated along the inner surface of the latch hook strip. The clamping collar is slidably disposed over the latch hook strips. The clamping collar comprises a pair of proximally-facing collar slanted platforms each configured to engage a corresponding distally-facing latch hook strip slanted platform. Sliding the clamping collar along the latch hook strips in a distal direction clamps the latch hooks to secure the connector body, and sliding the clamping collar along the latch hook strips in a proximal direction unclamps the latch hooks to release the connector body.

According to another aspect, a method comprises hooking an electrical connector body to an external connector by longitudinally sliding a clamping collar toward the external connector along a pair of longitudinal latch hook strips of the electrical connector body to clamp the latch hook strips onto the external connector and hook a pair of inward-facing latch hooks into a corresponding pair of latch hook grooves defined in the external connector, the latch hooks being defined along corresponding distal regions of the latch hook strips, the pair of latch hook strips comprising a corresponding pair of distally-facing, inner-surface supporting slanted platforms, the clamping collar comprising a pair of proximally-facing sliding slanted platforms; and unhooking the electrical connector body from the external connector by longitudinally sliding the clamping collar away from the external connector along the pair of latch hook strips, wherein the sliding slanted platforms are configured to press onto the supporting slanted platforms as the clamping collar is slid longitudinally away from the external connector.

BRIEF DESCRIPTION OF THE DRAWINGS

The foregoing aspects and advantages of the present invention will become better understood upon reading the following detailed description and upon reference to the drawings where.

DETAILED DESCRIPTION OF PREFERRED EMBODIMENTS

In the following description, it is understood that any recitation of an element refers to at least one element. A set of elements includes one or more elements. A plurality of elements includes two or more elements. Each recited element/structure can be formed by or be part of a monolithic structure, or be formed from multiple distinct structures. A recitation of two distinct elements does not exclude the two elements forming different parts of a single monolithic structure. Forward and backward designations refer to the direction of insertion/connection of a recited connector.

Figure 1:
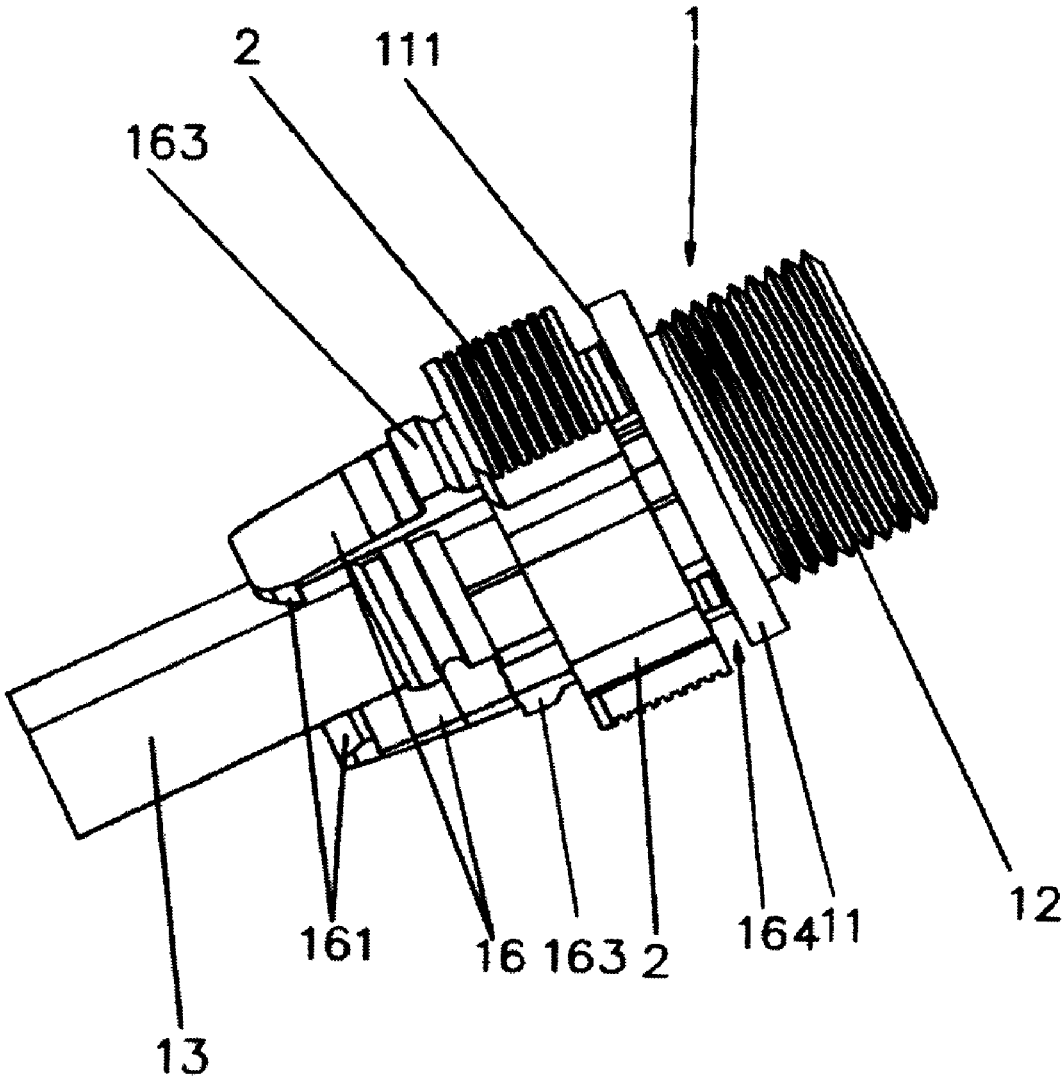
FIG. 1 shows a three-dimensional structural diagram of a connector according to some embodiments of the present invention.
Figure 2:
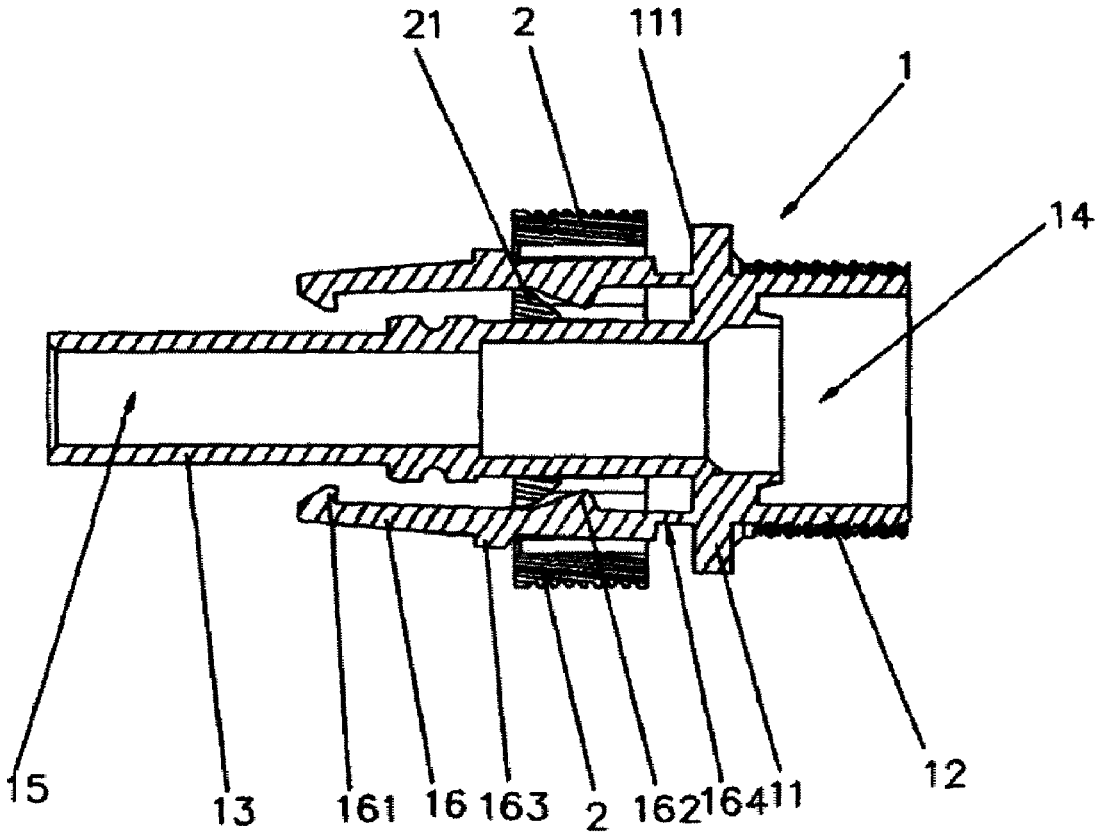
FIG. 2 shows a cross-sectional view of the connector of FIG. 1, according to some embodiments of the present invention.

FIGS. 1 and 2 show a connector assembly including a plastic clamping connector socket body 1, and a plastic collar ring 2 disposed over connector socket body 1. Connector body 1 includes a flange ring 11, a threaded coupling 12 coupled to a proximal (back) side of flange ring 11, and a generally-longitudinal elongated tube 13 coupled to a distal (front) side of flange ring 11. As shown in FIG. 1, elongated tube 13 may have a rectangular transverse cross-section. Elongated tube 13 is connected to flange ring 11 along a side platform 111 defined on a distal side of flange ring 11. Elongated tube 13 accommodates an electrical contact 4, shown in FIG. 3. Threaded coupling 12 has an inner bore 14, which is in communication with a tube cavity 15 of elongated tube 13.

A pair of generally-longitudinal latch hook strips (members) 16 are connected to side platform 111, and extend longitudinally away from flange ring 11 in a distal direction. Latch hook strips 16 are situated outside the outer surface of elongated tube 13. Latch hook strips 16 include corresponding inward-facing latch hooks 161 situated along a distal region, for example at the distal end, of an inner surface of latch hook strips 16. Each latch hook strip 16 includes a corresponding latch hook 161. Latch hook strips 16 also include corresponding distally-facing (front-facing) supporting slanted platforms 162, situated along the inner surface of latch hook strips 16 near flange ring 11. Each latch hook strip includes a corresponding slanted platform 162.

Collar ring 2 is slidably disposed over latch hook strips 16 and elongated tube 13. Collar ring 2 includes a pair of proximally-facing (backward-facing) sliding slanted platforms 21, situated along an inner surface of collar ring 2 and configured to engage the corresponding supporting slanted platforms 162 of latch hook strips 16 to transversely press latch hook strips 16. A sliding slanted platform 21 is provided for latch hook strip 16, and the number of sliding slanted platforms 21 of collar ring 2 is equal to the number of latch hook strips 16. When collar ring 2 is slid in a proximal direction, toward the rear of connector body 1, sliding slanted platforms 21 press against support slanted platforms 162, forcing latch hook strips to move outward.

As shown in FIGS. 1 and 2, latch hook strips 16 include corresponding outer-wall convex platforms 163. Platforms 163 are configured to press against the inner surface of collar ring 2 when collar ring 2 has been pushed forward into position, to ensure that latch hooks 161 cannot move outward and unhook spontaneously. Latch hook strips 16 further include flexing notches 164 defined along the outer surfaces of latch hook strips 16, adjacent to flange ring 11, at the location where latch hook strips 16 and flange ring 11 interconnect. Flexing notches 164 make the corresponding portion of latch hook strips 16 thinner, thus facilitating the transverse flexure of latch hook strips 16 and enabling front-end latch hooks 161 to spread open.

Figure 3:
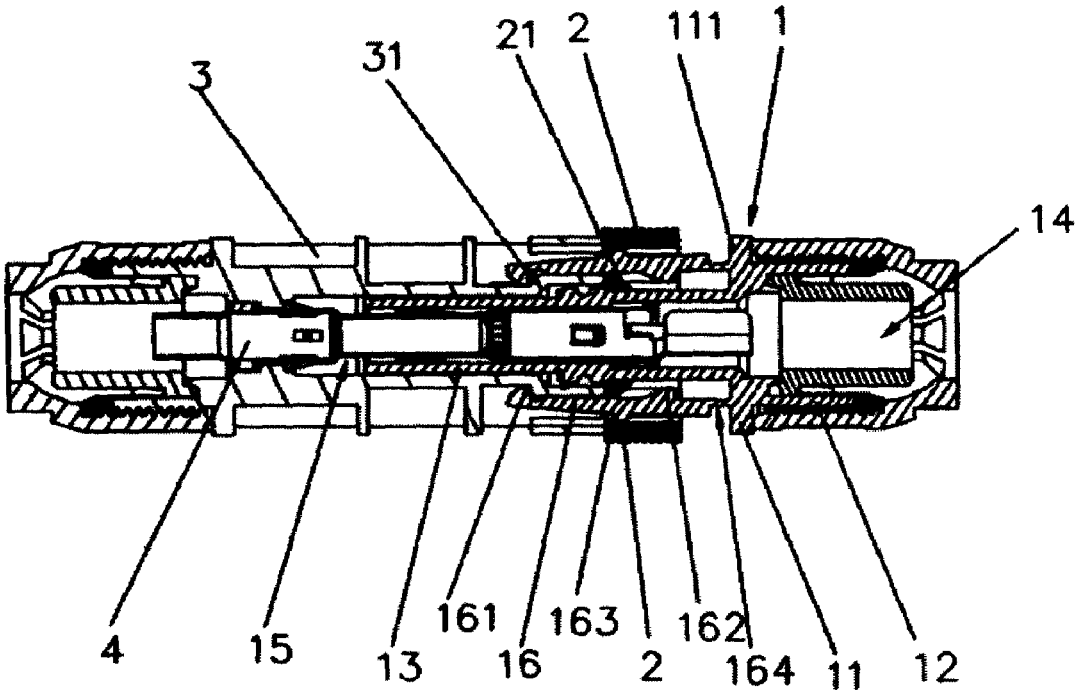
FIG. 3 shows a structural diagram of the connector of FIG. 1 mated to a complementary connector, according to some embodiments of the present invention.

FIG. 3 shows the connection assembly of FIGS. 1 and 2 in a utilization state, according to some embodiments of the present invention. Connector body 1 is used in conjunction with an external male end connector (plug) 3. When plug 3 is inserted properly into the clamping socket formed by connector body 1, latch hooks 161 clamp into corresponding latch hook grooves 31 defined along an outer surface of plug 3. When a user's hand pushes collar ring 2 forward, the inner surface of collar ring 2 presses central convex platforms 163 of latch hook strips 16, causing the spring arms of latch hooks 16 to shorten, which facilitates the locking of plug 3 by latch hook strips 161. When collar ring 2 is pulled backward, sliding slanted platforms 21 defined on the inner surface of collar ring 2 push support slanted platforms 162 of latch hook strips 16, causing latch hooks 161 to spread open. Latch hooks 161 exit clamp grooves 31 of plug 3, causing the two connector members to separate.

Exemplary embodiments described above provide a connector clamping socket structure allowing convenient opening and closure and stable connection. The stability of the connection is enhanced by a compression tightening action provided by the collar ring. The two connector members may be interconnected by simply inserting the plug into the socket, allowing the latch hooks of the latch hook strips to hook into their counterparts. The collar ring slides toward the front ends of the latch hook strips, and the convex platforms on the outside of the latch hook strips are compressed and tightened by the collar ring, causing the latch hook strips to hook more tightly onto their counterparts. The compression tightening provided by the collar ring prevents the opening of the latch hooks when, for example, external objects collide with the latch hooks. The two connector members may be disconnected by sliding the collar ring toward the rear end of the latch hook strips. The sliding slanted platforms of the collar ring press outward on the support slanted platforms of the latch hook strips, opening up and releasing the latch hooks at the front ends of the latch hook strips. Releasing the latch hooks allows separating the two connector members. The exemplary connection mechanisms described above allow convenient opening and closure, while the compression tightening action provided by the collar ring improves the reliability of the connection.

It will be clear to one skilled in the art that the above embodiments may be altered in many ways without departing from the scope of the invention. Accordingly, the scope of the invention should be determined by the following claims and their legal equivalents.

What is claimed is:

1. A connector assembly comprising:

an electrical connector body comprising an elongated tube, and a pair of opposing latch hook strips coupled to the elongated tube and extending along an outer surface of the elongated tube, each latch hook strip having an inward-facing latch hook situated along a distal region of an inner surface of said each latch hook strip, and a distally-facing latch supporting slanted platform situated along the inner surface of said each latch hook strip; and a clamping collar slidably disposed over the latch hook strips and comprising a pair of proximally-facing sliding slanted platforms each configured to engage a corresponding distally-facing supporting slanted platform to transversely press the latch hook strips outward when the clamping collar is slid along the latch hook strips in a proximal direction.

2. The connector assembly of claim 1, wherein the electrical connector body further comprises a proximal threaded coupling and a flange ring, the flange ring being disposed between the proximal threaded coupling and the elongated tube, the threaded coupling having an inner bore in communication with a tube cavity of the elongated tube.

3. The connector assembly of claim 2, wherein said each latch hook strip is coupled to the flange ring, said each latch hook strip comprising a flexing notch defined adjacent to the flange ring, for facilitating a transverse flexure of said each latch hook strip.

4. The connector assembly of claim 1, wherein said each latch hook strip further comprises an outer-wall convex platform situated along a central region of said each latch hook strip and configured to engage an inner surface of the clamping collar to impede a self-release of the clamping collar.

5. The connector assembly of claim 1, wherein said each latch hook strip comprises a flexing notch defined along a proximal region of the latch hook strip, for facilitating a transverse flexure of said each latch hook strip.

6. The connector assembly of claim 1, wherein the elongated tube has a rectangular transverse cross-section.

7. The connector assembly of claim 1, wherein the elongated tube and the pair of latch hook strips are integrally formed.

8. The connector assembly of claim 1, wherein the connector body comprises a connector socket comprising the elongated tube.

9. The connector assembly of claim 8, wherein the external connector comprises a plug electrically connected to the connector socket, the plug comprising a pair of latch hook grooves each sized to receive a corresponding latch hook.

10. A socket clamping structure comprising:

a socket body comprising a flange ring, a threaded coupling coupled to the flange ring along a proximal side of the flange ring, an elongated tube coupled to the flange ring along a distal side of the flange ring, for attaching to an external electrical connector, wherein the elongated tube comprises an inner tube cavity interconnected to an inner bore of the threaded coupling, and a pair of latch hook strips coupled to the flange ring along the distal side of the flange ring and extending along an outer surface of the elongated tube, the pair of latch hook strips comprising a corresponding pair of latch hooks situated along corresponding distal regions and inner sides of the latch hook strips, the pair of latch hook strips further comprising a corresponding pair of supporting slanted platforms situated along corresponding inner sides of the latch hook strips; and a clamping collar slidably disposed over the latch hook strips, comprising a pair of sliding slanted platforms along an inner wall of the clamping collar, the sliding slanted platforms being configured to press on the supporting slanted platforms as the clamping collar is slid over the latch hook strips.

11. An electrical connector assembly comprising:

an electrical connector body comprising a pair of opposing latch hook strips parallel to a longitudinal insertion direction of the electrical connector body, each latch hook strip having an inward-facing latch hook situated along a distal region of an inner surface of said each latch hook strip, and a distally-facing latch hook strip slanted platform situated along the inner surface of said each latch hook strip; and a clamping collar slidably disposed over the latch hook strips and comprising a pair of proximally-facing collar slanted platforms each configured to engage a corresponding distally-facing latch hook strip slanted platform, wherein sliding the clamping collar along the latch hook strips in a distal direction clamps the latch hooks to secure the connector body, and wherein sliding the clamping collar along the latch hook strips in a proximal direction unclamps the latch hooks to release the connector body.

12. A method comprising:

hooking an electrical connector body to an external connector by longitudinally sliding a clamping collar toward the external connector along a pair of longitudinal latch hook strips of the electrical connector body to clamp the latch hook strips onto the external connector and hook a pair of inward-facing latch hooks into a corresponding pair of latch hook grooves defined in the external connector, the latch hooks being defined along corresponding distal regions of the latch hook strips, the pair of latch hook strips comprising a corresponding pair of distally-facing, inner-surface supporting slanted platforms, the clamping collar comprising a pair of proximally-facing sliding slanted platforms; and unhooking the electrical connector body from the external connector by longitudinally sliding the clamping collar away from the external connector along the pair of latch hook strips, wherein the sliding slanted platforms are configured to press onto the supporting slanted platforms as the clamping collar is slid longitudinally away from the external connector.

13. The method of claim 12, further comprising threading a threaded coupling of the electrical connector body to secure a proximal end of the electrical connector body.

14. The method of claim 12, further comprising mating an elongated tube of the electrical connector body to the external connector, the latch hook strips extending along an outer surface of the elongated tube.

15. The method of claim 14, wherein the external connector comprises a plug electrically connected to a connector socket comprising the elongated tube.

* * * * *